US010094610B2

(12) United States Patent
Sexton et al.

(10) Patent No.: US 10,094,610 B2
(45) Date of Patent: Oct. 9, 2018

(54) MOVABLE MULLION

(71) Applicant: Electrolux Home Products, Inc., Charlotte, NC (US)

(72) Inventors: Terry Lynn Sexton, Anderson, SC (US); Jason Lee Purucker, Anderson, SC (US); Caleb Gossens, Kalamazoo, MI (US)

(73) Assignee: Electrolux Home Products, Inc., Charlotte, NC (US)

( * ) Notice: Subject to any disclaimer, the term of this patent is extended or adjusted under 35 U.S.C. 154(b) by 878 days.

(21) Appl. No.: 14/568,221

(22) Filed: Dec. 12, 2014

(65) Prior Publication Data

US 2015/0168048 A1 Jun. 18, 2015

Related U.S. Application Data

(60) Provisional application No. 61/915,174, filed on Dec. 12, 2013.

(51) Int. Cl.
*F25D 17/06* (2006.01)
*F25D 17/04* (2006.01)
(Continued)

(52) U.S. Cl.
CPC ..... *F25D 17/045* (2013.01); *F25D 17/065* (2013.01); *F25D 23/062* (2013.01);
(Continued)

(58) Field of Classification Search
CPC ..... F25D 17/045; F25D 23/069
See application file for complete search history.

(56) References Cited

U.S. PATENT DOCUMENTS 3,027,732 A 4/1962 Mann et al.
3,248,894 A * 5/1966 Harbour ..... F25D 17/065 62/151
(Continued)

FOREIGN PATENT DOCUMENTS

CN 2126649 Y 1/1993
GB 1111397 A 4/1968
WO WO 2005003659 A1 * 1/2005 ..... F25B 39/022

OTHER PUBLICATIONS

Partial International Search Report for PCT/US2014/069941 dated Apr. 2, 2015, 5 pages.

*Primary Examiner* — Ned Landrum
*Assistant Examiner* — Antonio R Febles
(74) *Attorney, Agent, or Firm* — Pearne & Gordon LLP

(57) ABSTRACT

A refrigerator includes a cabinet defining a storage compartment and a door movably coupled to the cabinet for providing selective access to at least a portion of the storage compartment. The refrigerator includes an evaporator unit and an air duct providing fluid communication between the evaporator unit and the storage compartment. The refrigerator includes a partition member coupled to the cabinet that divides the storage compartment into a first compartment having a first volume and a second compartment having a second volume. The partition member is movable between a first position and a second position to adjust the first and second volumes. The partition member can include an air channel extending through the partition member that is in fluid communication with at least one of the first and second compartments. The partition member can include a baffle member that is adjustable to adjustably direct air passing through the air channel.

16 Claims, 7 Drawing Sheets

(51) Int. Cl.
*F25D 23/06* (2006.01)
*F25D 23/10* (2006.01)

(52) U.S. Cl.
CPC ..... *F25D 23/10* (2013.01); *F25D 2317/0653* (2013.01); *F25D 2400/16* (2013.01)

(56) References Cited

U.S. PATENT DOCUMENTS 3,590,594 A 7/1971 Arend
3,605,431 A 9/1971 Carson
3,726,578 A 4/1973 Armstrong
4,304,101 A 12/1981 Gidseg
4,467,618 A 8/1984 Gidseg
4,638,644 A 1/1987 Gidseg
4,671,074 A 6/1987 Gostelow et al.
4,671,078 A * 6/1987 Pink ..... F25D 17/065 239/587.1
4,876,870 A 10/1989 Rantanen
5,577,822 A 11/1996 Seon
5,720,185 A * 2/1998 Lee ..... A47F 3/0408 62/329
5,722,252 A 3/1998 Kang et al.
5,881,568 A * 3/1999 Kim ..... F25D 17/065 251/253
5,884,496 A 3/1999 Kim et al.
5,992,165 A * 11/1999 Kim ..... F25D 17/045 62/187
6,547,349 B2 4/2003 Sessa et al.
6,584,790 B1 * 7/2003 Lopes ..... F25D 17/045 165/294
6,751,980 B1 * 6/2004 Lopes ..... F25D 17/065 62/407
6,779,357 B1 8/2004 Fann
7,032,408 B2 4/2006 Dentella et al.
7,254,960 B2 8/2007 Schmid et al.
7,263,856 B2 * 9/2007 Choi ..... F25D 17/045 62/408
8,146,383 B2 4/2012 Lorek et al.
8,336,321 B2 12/2012 Cur et al.
8,453,476 B2 6/2013 Kendall et al.
2006/0005567 A1 * 1/2006 Lee ..... F25D 17/045 62/408
2006/0086126 A1 4/2006 Montuoro
2009/0056364 A1 * 3/2009 Gorz ..... F25D 17/065 62/407
2012/0011879 A1 1/2012 Gu

* cited by examiner

MOVABLE MULLION

TECHNICAL FIELD

The present disclosure relates to a refrigerator and more particularly, to a refrigerator having a movable mullion.

BACKGROUND

A refrigerator can include a cabinet having a bottom wall, a top wall, a rear wall and a pair of opposing side walls defining a storage compartment. The refrigerator can further include a door movably coupled to the cabinet for providing selective access to the storage compartment. In some example, the refrigerator can include a mullion portion that divides the storage compartment into a first compartment having a first volume and a second compartment having a second volume. One of the first and second compartments can be a fresh-food compartment while the other of the first and second compartments is a freezer compartment.

SUMMARY

The following presents a simplified summary of the disclosure in order to provide a basic understanding of some example aspects described in the detailed description.

In a first aspect, a refrigerator comprises a cabinet having a rear wall and a pair of opposing side walls defining a storage compartment. The refrigerator further comprises a door movably coupled to the cabinet for providing selective access to at least a portion of the storage compartment, the door being movable between an open position and a closed position. The refrigerator further comprises an evaporator unit for cooling air within the storage compartment and an air duct providing fluid communication between the evaporator unit and the storage compartment. The refrigerator further comprises a partition member coupled to the cabinet that divides the storage compartment into a first compartment having a first volume and a second compartment having a second volume. The partition member is movable between a first position and a second position to adjust the first volume and second volume. The partition member comprises an air channel extending through the partition member, the air channel being in fluid communication with at least one of the first compartment and the second compartment. The partition member comprises a baffle member that is adjustable to adjustably direct air passing through the air channel.

In one example of the first aspect, the baffle member is rotatable to adjustably direct air passing through the air channel.

In another example of the first aspect, the air channel is in fluid communication with the first compartment through a first aperture and the air channel is in fluid communication with the second compartment through a second aperture. In one example, the baffle member is rotatable to a first position wherein the baffle member is positioned to direct air passing through the air channel away from the second aperture and through the first aperture into the first compartment. In another example, the baffle member is rotatable to a second position wherein the baffle member is positioned to direct air passing through the air channel away from the first aperture and through the second aperture into the second compartment.

In yet another example of the first aspect, the cabinet comprises a first coupling structure and a second coupling structure. The partition member is selectively engageable with the first coupling structure to selectively couple the partition member in the first position and the partition member is selectively engageable with the second coupling structure to selectively couple the partition member in the second position. In one example, the first coupling structure and the second coupling structure both comprise a rail member provided by one of the opposing side walls or the rear wall that the partition member can selectively rest upon. In another example, the first coupling structure and the second coupling structure both comprise a recess provided by one of the opposing side walls or the rear wall that an insertion member of the partition member can selectively be inserted into.

In still yet another example of the first aspect, the refrigerator further comprises a seal member arranged to provide a seal between the partition member and the door when the partition member is in the first position and the door is in the closed position. In one example, the seal member is attached to the partition member. In another example, the seal member is selectively attachable to a first connecting structure of the door to provide the seal between the partition member and the door when the partition member is in the first position and the door is in the closed position. The seal member is further selectively attachable to a second connecting structure of the door to provide a seal between the partition member and the door when the partition member is in the second position and the door is in the closed position. In still another example, the refrigerator further comprises a storage member selectively attachable to the first connecting structure and selectively attachable to the second connecting structure.

In another example of the first aspect, the air duct comprises a first opening providing fluid communication between the air duct and the first compartment through the first opening and a second opening providing fluid communication between the air duct and the second compartment through the second opening. In one example, the refrigerator further comprises a flow control device that is adjustable to control an amount of fluid communication through at least one of the first opening and the second opening. In another example, the refrigerator further comprises a controller configured to automatically operate the flow control device based on a position of the partition member. In yet another example, the refrigerator further comprises a sensor configured to detect the position of the partition member and send an input to the controller to indicate what position is detected.

In yet another example of the first aspect, the air duct comprises a first opening and a second opening. The partition member is selectively engageable with the first opening to provide fluid communication between the air channel and the air duct through the first opening when the partition member is in the first position and the partition member is selectively engageable with the second opening to provide fluid communication between the air channel and the air duct through the second opening when the partition member is in the second position. In one example, the first and second openings each comprise a diaphragm having a hole that an insertion portion of the partition member can be selectively inserted through to provide fluid communication between the air channel and the air duct.

The first aspect may be carried out alone or with one or any combination of the examples of the first aspect discussed above.

In a second aspect, a refrigerator comprises a cabinet defining a storage compartment and a door movably coupled to the cabinet for providing selective access to at least a portion of the storage compartment, the door being movable between an open position and a closed position. The refrigerator further comprises a partition member coupled to the cabinet that divides the storage compartment into a first compartment having a first volume and a second compartment having a second volume, wherein the partition member is movable between a first position and a second position to adjust the first volume and second volume. The refrigerator further comprises an evaporator unit for cooling air within the storage compartment and an air duct providing fluid communication between the evaporator unit and the storage compartment. The air duct comprises a first opening providing fluid communication between the air duct and the first compartment through the first opening. The air duct further comprises a second opening providing fluid communication between the air duct and the second compartment through the second opening. The refrigerator further comprises a flow control device that is adjustable to control an amount of fluid communication through at least one of the first opening and the second opening. The refrigerator further comprises a controller configured to automatically operate the flow control device based on a position of the partition member.

In a third aspect, a refrigerator comprises a cabinet having a rear wall and a pair of opposing side walls defining a storage compartment and a door movably coupled to the cabinet for providing selective access to at least a portion of the storage compartment, the door being movable between an open position and a closed position. The refrigerator further comprises an evaporator unit for cooling air within the storage compartment and an air duct providing fluid communication between the evaporator unit and the storage compartment. The air duct comprises a first opening and a second opening. The refrigerator further comprises a partition member coupled to the cabinet that divides the storage compartment into a first compartment having a first volume and a second compartment having a second volume, the partition member comprising an air channel. The partition member is movable between a first position and a second position to adjust the first volume and second volume. The partition member is selectively engageable with the first opening to provide fluid communication between the air channel and the air duct through the first opening when the partition member is in the first position and the partition member is selectively engageable with the second opening to provide fluid communication between the air channel and the air duct through the second opening when the partition member is in the second position. The first and second openings each comprise a diaphragm having a hole that an insertion portion of the partition member can be selectively inserted through to provide fluid communication between the air channel and the air duct.

DETAILED DESCRIPTION OF THE DRAWINGS

Embodiments of the invention are better understood when the following detailed description is read with reference to the accompanying drawings, in which.

DETAILED DESCRIPTION

Figure 1:
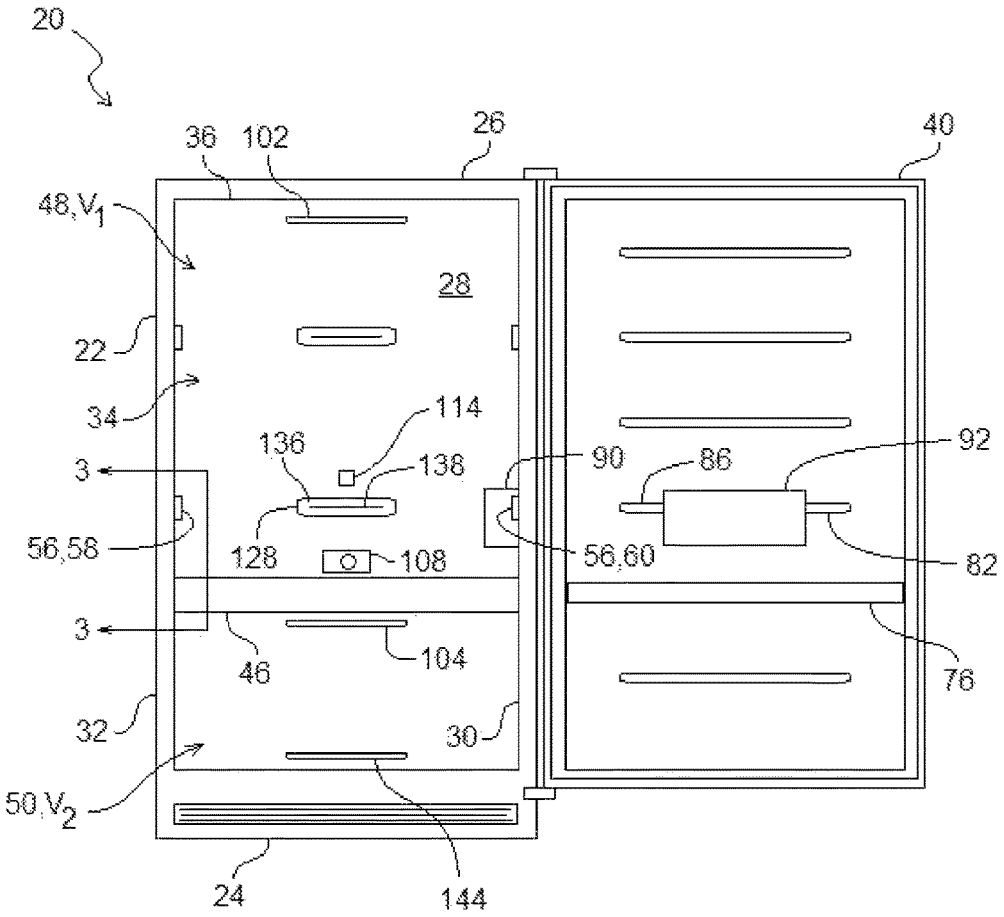
FIG. 1 is a front view of an example refrigerator with a partition member in a first position.

Examples incorporating one or more embodiments are described and illustrated in the drawings. These illustrated examples are not intended to be limiting. For example, one or more aspects of an embodiment may be utilized in other embodiments and even other types of devices, such as a bottom-mount refrigerator, a top-mount refrigerator, or a side-by-side refrigerator.

Referring now to FIGS. 1-4, an example refrigerator 20 is shown that comprises a cabinet 22 having a bottom wall 24, a top wall 26, a rear wall 28 and a pair of opposing side walls 30, 32 defining a storage compartment 34 and an opening 36 to the storage compartment 34. The refrigerator 20 can comprise a door 40 movably coupled to the cabinet 22 for providing selective access to at least a portion of the storage compartment 34, the door 40 being movable between and open position and a closed position. For instance, the door 40 in the present example is pivotally attached to the side wall 30 with one or more hinges and extends across the entire opening 36 in the closed position. However, in some embodiments, the door 40 may be pivotally attached to other walls of the cabinet 22. Moreover, in some embodiments, the door 40 may extend only partially across the opening 36 in the closed position. In such embodiments, the cabinet 22 may comprise one or more extra doors that extend across remaining portions of the opening 36 in a closed position.

The refrigerator 20 can comprise a partition member 46, such as, for example, a mullion portion, coupled to the cabinet 22 that divides the storage compartment 34 into a first compartment 48 having a first volume $V_1$ and a second compartment 50 having a second volume $V_2$. In some embodiments, one of the first and second compartments 48, 50 can be a fresh-food compartment while the other of the first and second compartments 48, 50 can be a freezer compartment. In other embodiments, both of the first and second compartments 48, 50 can be a fresh-food compartment or both of the first and second compartments 48, 50 can be a freezer compartment.

The partition member 46 can be movable between multiple positions to adjust the first volume $V_1$ and second volume $V_2$. For example, the partition member 46 can be movable between a first position (shown in FIG. 1) and a second position (shown in FIG. 2) to adjust the first volume $V_1$ and second volume $V_2$. Moreover, the partition member 46 in some embodiments can be movable between more than two positions to adjust the first volume $V_1$ and second volume $V_2$.

Figure 2:
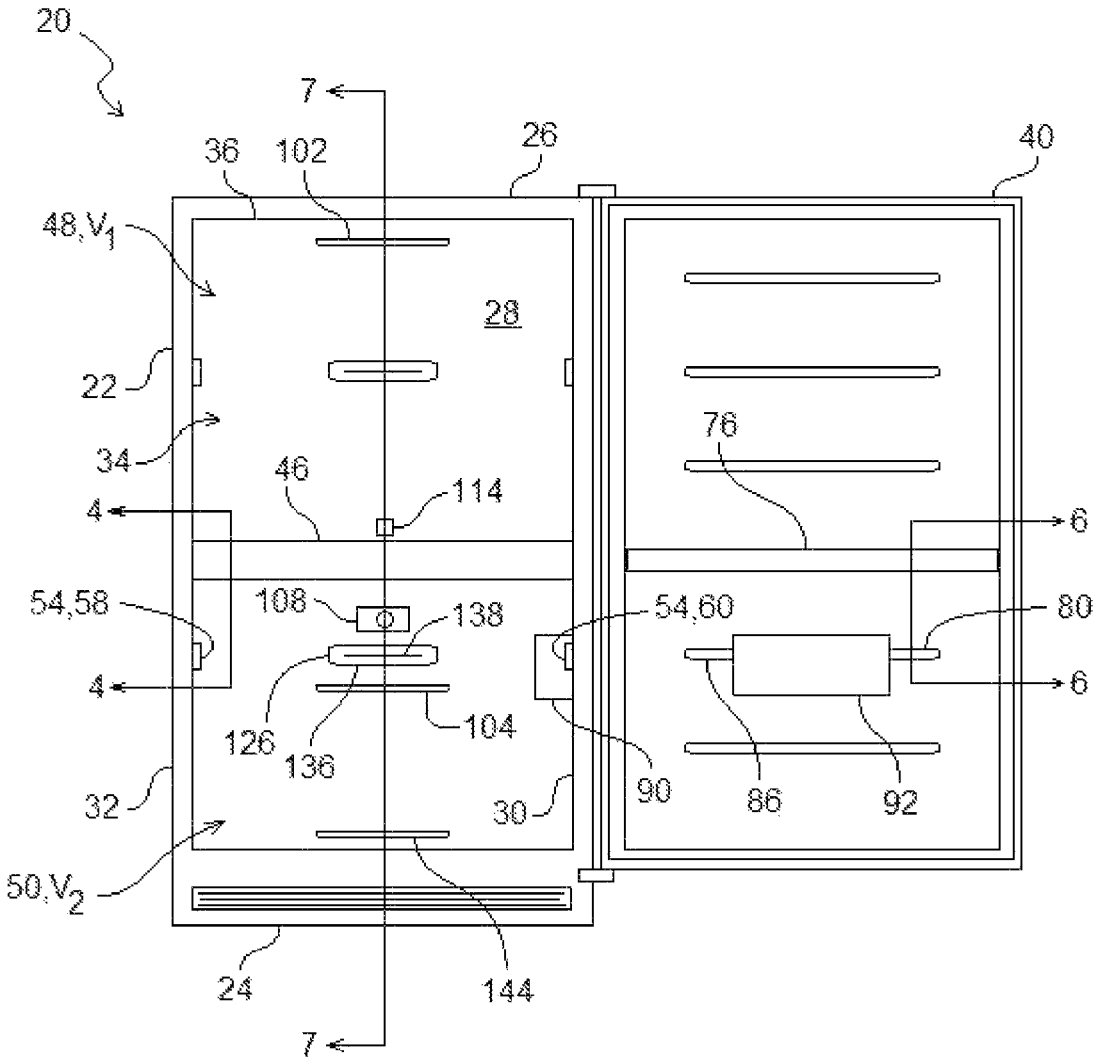
FIG. 2 is a front view of the refrigerator with the partition member in a second position.
Figure 3:
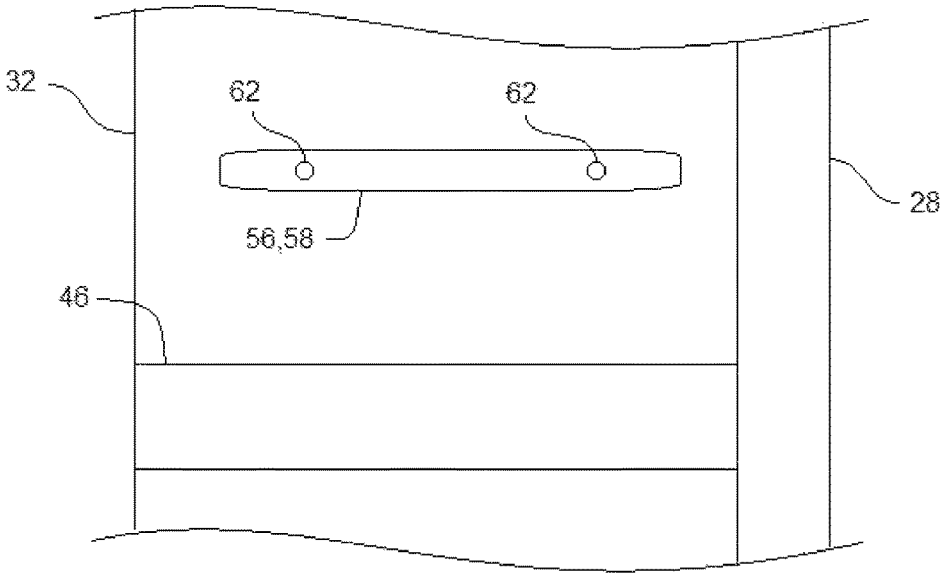
FIG. 3 is a cross-sectional view of the refrigerator taken along line 3-3 in FIG. 1.
Figure 4:
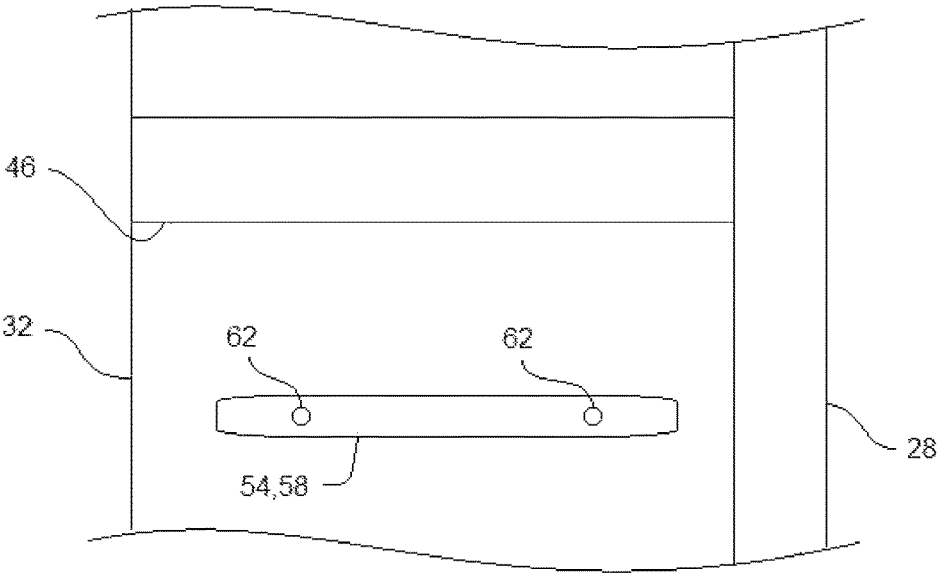
FIG. 4 is a cross-sectional view of the refrigerator taken along line 4-4 in FIG. 2.

As shown in FIGS. 1 & 2, the partition member 46 can be arranged horizontally in the first and second positions such that the first and second compartments 48, 50 are aligned vertically with respect to each other. However, in some embodiments, the partition member 46 can be arranged vertically in the first and second positions such that the first and second compartments 48, 50 are aligned horizontally with respect to each other.

The cabinet 22 can comprise coupling structure that the partition member 46 can be selectively engageable with to selectively couple the partition member 46 in its various positions. For example, the cabinet 22 can comprise a first coupling structure 54 and a second coupling structure 56. The partition member 46 can be selectively engageable with the first coupling structure 54 to selectively couple the partition member 46 in the first position and the partition member 46 can be selectively engageable with the second coupling structure 56 to selectively couple the partition member 46 in the second position.

The first coupling structure 54 and the second coupling structure 56 can each comprise one or more rail members provided by any of the opposing side walls 30, 32 and rear wall 28 that can slidably engage with and support the partition member 46. For example, the first coupling structure 54 and the second coupling structure 56 can each comprise a first rail member 58 provided by the side wall 32 and a second rail member 60 provided by the side wall 30 that corresponds to the first rail member 58 and is provided on the same horizontal plane.

In addition or alternatively, the first coupling structure 54 and the second coupling structure 56 can each comprise one or more recesses (e.g., holes 62) provided by any of the opposing side walls 30, 32 and rear wall 28 that one or more corresponding insertion members 64 (shown in FIG. 5) of the partition member 46 can be selectively inserted into. Each hole 62 may correspond with another hole 62 provided on a same horizontal plane in the same cabinet wall. Each hole 62 may also correspond with another hole 62 provided on a same horizontal plane on an opposite cabinet wall.

Figure 5:
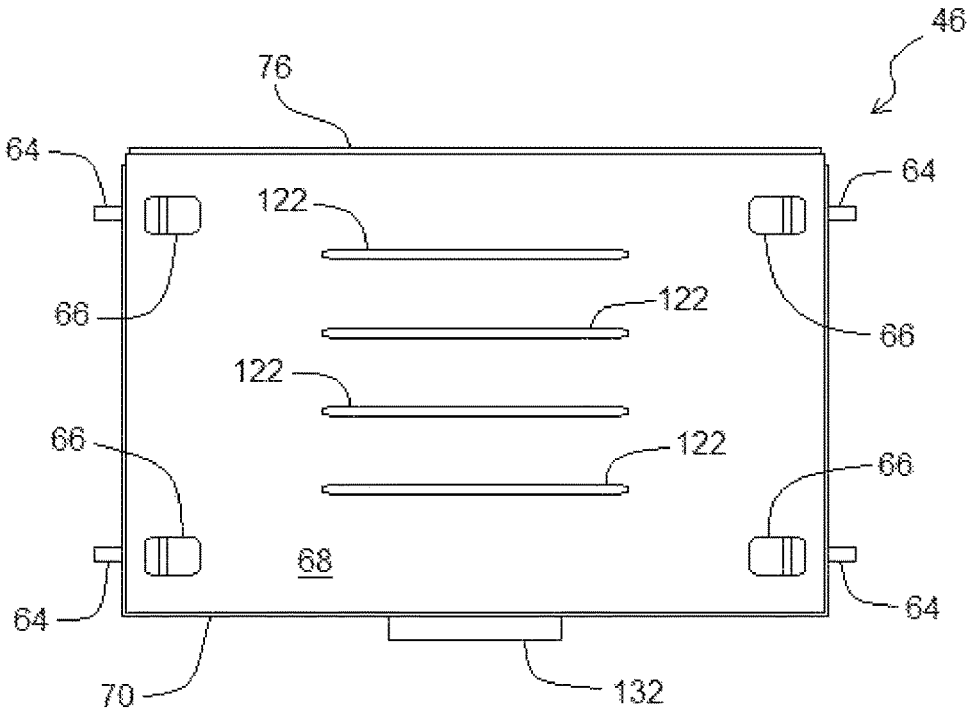
FIG. 5 is a bottom view of an example partition member.

As shown in FIG. 5, the partition member 46 can comprise one or more snap mechanisms 66 having a spring or other biasing element that biases the insertion members 64 into the corresponding holes 62 when the partition member 46 is in the first or second position. The snap mechanisms 66 may be built into a bottom surface 68 of the partition member 46 and can be operated to remove the insertion members 64 from the corresponding holes 62 to enable removal of the partition member 46 from the first or second position. More specifically, the snap mechanisms 66 can include a lever that can be pulled to withdraw the insertion members 64 from the corresponding holes 62 when it is desired to remove the partition member 46 from the first or second position.

The first coupling structure 54 and the second coupling structure 56 need not be limited to the example structure discussed above and indeed can comprise any structure that can selectively couple the partition member 46 in the first or second position such as, for example, hooks, clips, or insertion members for insertion into corresponding holes in the partition member 46. Moreover, similar coupling structure may be used to selectively couple the partition member 46 in positions other than the first and second positions discussed above.

Still referring to FIG. 5, the refrigerator 20 can further comprise a seal member 70 arranged to provide a seal between the partition member 46 and at least one wall of the cabinet 22 when the partition member 46 is selectively coupled to the cabinet 22 that inhibits the flow of air between the first and second compartments 48, 50. In some embodiments, the seal member 70 may be integral with or attached to the partition member 46, as shown in present example. In other embodiments, the seal member 70 may be attached to a wall of the cabinet 22 instead. The seal member 70 may comprise a gasket, spacer, or any other appropriate sealing material known to those of ordinary skill in the art that can be used to provide a seal between the partition member 46 and the cabinet 22

The seal member 70 can extend around a perimeter portion of the partition member 46 such that the seal member 70 forms a seal between the partition member 46 and both of the opposing side walls 30, 32 and the rear wall 28 when the partition member 46 is in either of the first and second positions. However, in other embodiments, the seal member 70 may extend around a perimeter portion of the partition member 46 such that the seal member 70 forms a seal between the partition member 46 and only one of the opposing side walls 30, 32 and/or the rear wall 28 when the partition member 46 is in either of the first and second positions.

Referring now to FIGS. 1-2 & 5-6, the refrigerator 20 can further comprise another seal member 76 arranged to provide a seal between the partition member 46 and the door 40 when the partition member 46 is selectively coupled to the cabinet 22 that inhibits the flow of air between the first and second compartments 48, 50. The seal member 76 may comprise a gasket, spacer, or any other appropriate sealing material known to those of ordinary skill in the art that can be used to provide a seal between the partition member 46 and the door 40.

In some embodiments, the seal member 76 may be integral or fixedly attached to the partition member 46, as shown in FIG. 5. For embodiments wherein the refrigerator 20 also comprises the seal member 70 discussed above, the seal member 76 may be integral with the seal member 70 or the seal member 76 may be a separate component. The seal member 76 can extend across a perimeter portion of the partition member 46 such that the seal member 76 forms a seal between the partition member 46 and the door 40 when the door 40 is in the closed position and the partition member 46 is in either of the first and second positions.

Figure 6:
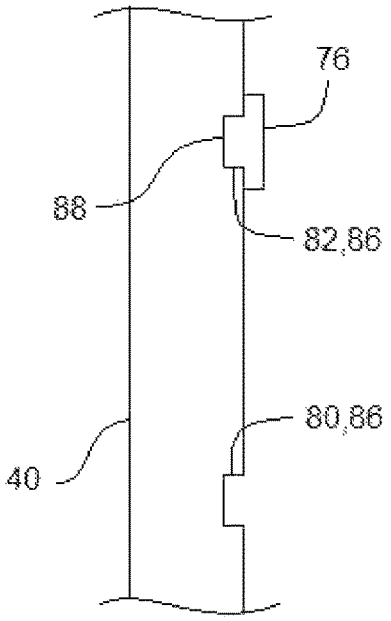
FIG. 6 is a cross-sectional view of the refrigerator taken along line 6-6 in FIG. 2.

In other embodiments, the seal member 76 may not be fixedly attached to the partition member 46 and instead may be attached to the door 40. For example, as shown in FIGS. 1-2 & 6, the door 40 can comprise a first connecting structure 80 and a second connecting structure 82. The seal member 76 can be selectively attachable with the first connecting structure 80 to provide a seal between the partition member 46 and the door 40 when the partition member 46 is in the first position and the door 40 is in the closed position. The seal member 76 may further be selectively attachable to a second connecting structure 82 of the cabinet 22 to provide a seal between the partition member 46 and the door 40 when the partition member 46 is in the second position and the door 40 is in the closed position. The first connecting structure 80 and the second connecting structure 82 can each comprise a horizontal recess 86 provided by the door 40 that an insertion member 88 of the seal member 76 can be selectively inserted into to attach the seal member 76 to the door 40, though the first connecting structure 80 and/or the second connecting structure 82 can comprise other types of connecting structure for connecting the seal member 76 to the door 40 without departing from the scope of the invention.

The refrigerator 20 can further comprise one or more storage members selectively attachable to the first and second coupling structures 54, 56 and/or the first and second connecting structures 80, 82 discussed above. For example, as shown in FIGS. 1 & 2, the refrigerator 20 can comprise a storage member 90 that is selectively attachable to the first coupling structure 54 of the cabinet 22 and selectively attachable to the second coupling structure 56 of the cabinet 22. The storage member 90 may comprise a bin, a tray, a shelf, or any other member capable of storing articles when selectively attached to the cabinet 22. Since both the partition member 46 and the storage member 90 are selectively attachable to the first and second coupling structures 54, 56 of the cabinet 22, the partition member 46 and the storage member 90 can be arranged to provide a variety of configurations. For instance, the partition member 46 can be attached to the first coupling structure 54 while the storage member 90 is connected to the second coupling structure 54 or the partition member 46 can be connected to the second coupling structure 54 while the storage member 90 is connected to the first coupling structure 54.

As another example, the refrigerator 20 can comprise a storage member 92, as further shown in FIGS. 1 & 2, that is selectively attachable to the first connecting structure 80 of the door 40 and selectively attachable to the second connecting structure 82 of the door 40. The storage member 92 may comprise a bin, a tray, a shelf, or any other member capable of storing articles when selectively attached to the door 40. Since both the storage member 92 and the seal member 76 are selectively attachable to the first and second connecting structures 80, 82 of the door 40, the storage member 92 and the seal member 76 can be arranged to provide a variety of configurations. For example, the seal member 76 can be connected to the first connecting structure 80 while the storage member 92 is connected to the second connecting structure 82 or the seal member 76 can be connected to the second connecting structure 82 while the storage member 92 is connected to the first connecting structure 80.

Figure 7:
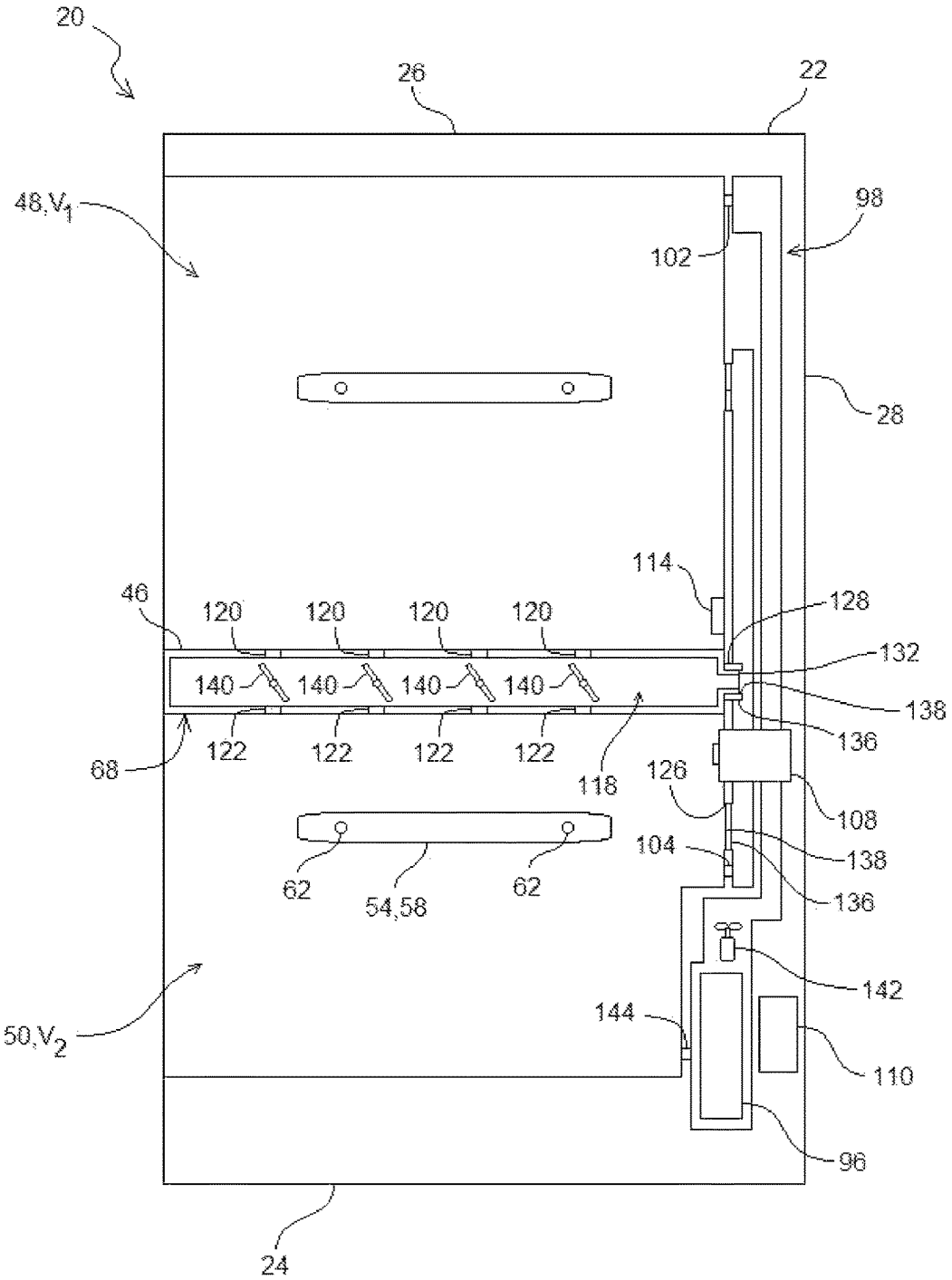
FIG. 7 is a cross-sectional view of the refrigerator taken along line 7-7 in FIG. 2.

Turning to FIG. 7, the refrigerator 20 can further comprise an evaporator unit 96 for cooling air within the storage compartment 34 and an air duct 98 providing fluid communication between the evaporator unit 96 and the storage compartment 34. The air duct 98 can extend through any or both of the opposing side walls 30, 32 and/or the rear wall 28 or the air duct 98 can be a separate component that is attached thereto. The air duct 98 can act as a delivery duct that delivers cooled air from evaporator unit 96 to the first and/or second compartments 48, 50 or the air duct 98 can act as a return duct that receives air from the first and/or second compartments 48, 50 for returning to the evaporator unit 96.

The air duct 98 can comprise one or more openings to provide fluid communication between the air duct 98 and the storage compartment 34 through the one or more openings. For example, the air duct 98 can comprise an opening 102 providing fluid communication between the air duct 98 and the first compartment 48 through the opening 102. As another example, the air duct 98 can comprise an opening 104 providing fluid communication between the air duct 98 and the second compartment 50 through the opening 104. One or both of the openings 102, 104 may be an air outlet delivering air from the air duct 98 to the storage compartment 34 or an air inlet returning air from the storage compartment 34 to the air duct 98.

In the present embodiment, the opening 102 is arranged such that the opening 102 provides fluid communication between the air duct 98 and the first compartment 48 when the partition member 46 is in the first position and also when the partition member 46 is in the second position. Also, the opening 104 is arranged such that the opening 104 provides fluid communication between the air duct 98 and the second compartment 50 when the partition member 46 is in the first position and also when the partition member 46 is in the second position. However, in some embodiments, the openings 102, 104 may be arranged such that the compartment provided in communication with the air duct 98 by the openings 102, 104 varies depending on what position the partition member 46 is in. For example, in one embodiment, the opening 102 may be arranged to provide fluid communication between the air duct 98 and the first compartment 48 when the partition member 46 is in the first position but provide fluid communication between the air duct 98 and the second compartment 50 when the partition member 46 is in the second position.

The refrigerator 20 can further comprise a flow control device 108 that is adjustable to control an amount of fluid communication through at least one of the openings 102, 104. For example, the flow control device 108 may be a mechanical damper or a blower that is provided within the air duct 98 that is adjustable to control an amount of fluid communication through at least one of the openings 102, 104. However, the flow control device 108 may be located outside of the air duct 98 and/or may comprise other mechanical or electro-mechanical devices that could be adjusted to control an amount of fluid communication through at least one of the openings 102, 104.

In some embodiments, the flow control device 108 may be operated manually by a user of the refrigerator 20. However, in other embodiments, the refrigerator 20 can comprise a controller 110 that is configured to automatically operate the flow control device 108 based on the position of the partition member 46. For example, when the partition member 46 is in the first position, the controller 110 may be configured to operate the flow control device 108 such that a first amount of fluid communication is provided at the opening 102. Additionally, when the partition member 46 is in the second position, the controller 110 may be configured to operate the flow control device 108 such that a second amount of fluid communication is provided at the opening 102. Notably, the volume $V_1$ of the first compartment 48 is smaller when the partition member 46 is in the second position compared to the first position. As such, the second amount of fluid communication may be less than the first amount of fluid communication to account for the change in volume and maintain a consistent amount of cooling of the first compartment 46 at each position of the partition member 46. However, in other embodiments, the second amount of fluid communication may be greater than the first amount of fluid communication.

In addition or alternatively, when the partition member 46 is in the first position, the controller 110 may be configured to operate the flow control device 108 such that a first amount of fluid communication is provided at the opening 104. Meanwhile, when the partition member 46 is in the second position, the controller 110 may be configured to operate the flow control device 108 such that a second amount of fluid communication is provided at the opening 104. Notably, the volume $V_2$ of the second compartment 50 is greater when the partition member 46 is in the second position compared to the first position. As such, the second amount of fluid communication may be greater than the first amount of fluid communication to account for the change in volume and maintain a consistent amount of cooling of the second compartment 50 at each position of the partition member 46. However, in other embodiments, the second amount of fluid communication may be less than the first amount of fluid communication.

An input may be provided to the controller 110 to indicate what position the partition member 46 is in. For example, a user may enter the position of the partition member 46 on a control panel of the refrigerator 20, which is configured to then send an input to the controller 110 to indicate what position has been entered. As another example, the refrigerator may comprise a sensor 114 that is configured to detect a position of the partition member 46 and send an input to the controller 110 to indicate what position is detected. The sensor 114 can be a proximity sensor, a limit switch, or any other electro-mechanical means configured to detect a position of the partition member 46 and send an input to the controller 110 to indicate what position is detected.

In some embodiments, the partition member 46 can comprise an air channel 118 extending through the partition member 46 that is in fluid communication with at least one of the first and second compartments 48, 50. For example, the partition member 46 may comprise one or more apertures 120 and the air channel 118 may be in fluid communication with the first compartment 48 through the apertures 120. In addition or alternatively, the partition member 46 may comprise one or more apertures 122 and the air channel 118 may be in fluid communication with the second compartment 48 through the apertures 122.

The partition member 46 can be selectively engageable with openings in the air duct 98 to provide fluid communication between the air channel 118 and the air duct 98 through the openings. For example, the air duct 98 can comprise openings 126, 128. One or both of the openings 126, 128 may be an air outlet for delivering air from the air duct 98 to the air channel 118 or one or both of the openings 126, 128 may be an air inlet for returning air from the air channel 118 to the air duct 98. The partition member 46 can be selectively engageable with the opening 126 to provide fluid communication between the air channel 118 and the air duct 98 through the opening 126 when the partition member 46 is in the first position. Additionally or alternatively, the partition member 46 can be selectively engageable with the opening 128 to provide fluid communication between the air channel 118 and the air duct 98 through the opening 128 when the partition member 46 is in the second position. More specifically, the partition member 46 can be selectively engageable with one or both of the openings 126, 128 by inserting an insert portion 132 into the opening, thus providing fluid communication between the air channel 118 and the air duct 98.

In some embodiments, one or both of the openings 126, 128 can each comprise a closing member that, when the partition member 46 is not selectively engaged with the opening, is configured to inhibit fluid communication through the opening relative to when the partition member 46 is selectively engaged with the opening. For example, one or both of the openings 126, 128 can each comprise an elastic diaphragm 136 having a hole 138 that, when the partition member 46 is not selectively engaged with the opening, has a first cross-sectional area and provides a first amount of fluid communication through the opening. The hole 138 can be elastically expanded to a second cross-sectional area that is greater than the first cross-sectional area to permit selective insertion of the insertion portion 132 of the partition member 46 therethrough. When the insertion portion 132 is selectively inserted through the hole 138, a second amount of fluid communication between the air channel 118 and the air duct 98 through the opening is established that is greater than the first amount of fluid communication. If the insertion portion 132 of the partition member 46 is then removed from the hole 138, the hole 138 of the diaphragm 136 will shrink back to its first cross-sectional area and provide the first amount of fluid communication through the opening.

Although the closing member in the above example is an elastic diaphragm 136, the closing member in other examples may comprise other means for inhibiting fluid communication through the opening relative when the partition member 46 is not selectively engaged with the openings such as for example, a pivoting door, a sliding door, or any other means for inhibiting fluid communication through the opening.

Figure 8:
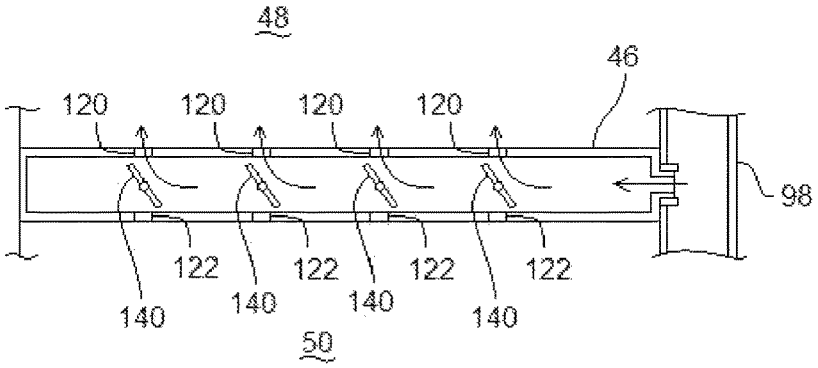
FIG. 8 is a cross-sectional view of the partition member having baffle members in a first position.
Figure 9:
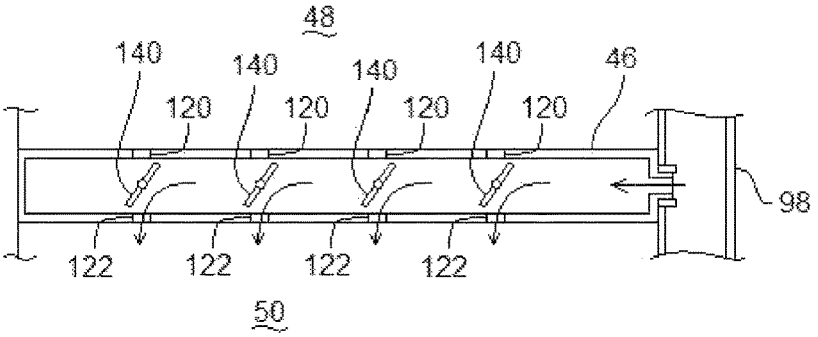
FIG. 9 is a cross-sectional view of the partition member wherein the baffle members are in a second position.
Figure 10:
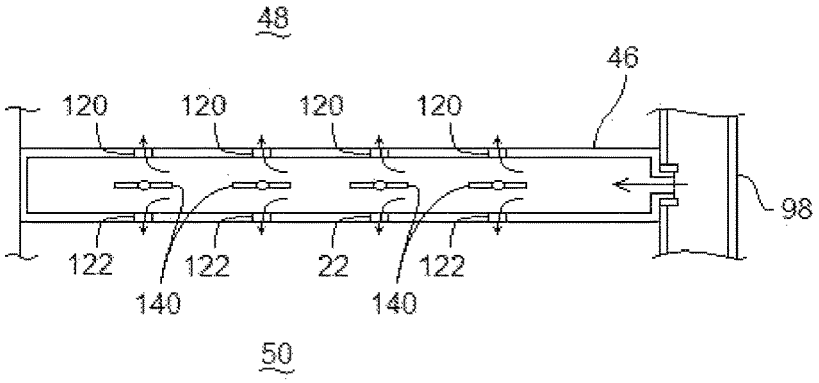
FIG. 10 is a cross-sectional view of the partition member wherein the baffle members are in an intermediate position.

In some examples, the partition member 46 can further comprise one or more baffle members 140 that are adjustable to adjustably direct air passing through the air channel 118. For instance, FIGS. 8-10 show examples wherein baffle members 140 are rotatable to adjustably direct air passing through the air channel 118 from the air duct 98 to the first and/or second compartments 48, 50. For example, as shown in FIG. 8, the baffle members 140 may be rotated to a first position, wherein the baffle members 140 are positioned to direct air passing through the air channel 118 from the air duct 98 away from the apertures 122 and through the apertures 120 into the first compartment 48. As another example, the baffle members 140 may be rotated to a second position, as shown in FIG. 9, wherein the baffle members 140 are positioned to direct air passing through the air channel 118 from the air duct 98 away from the apertures 120 and through the apertures 122 into the second compartment 50. As yet another example, the baffle members 140 may be rotated to an intermediate position, as shown in FIG. 10, wherein the baffle members 140 are positioned parallel to the airflow through the air channel 118 from the air duct 98 such that the air is split and directed towards both the apertures 120, 122 by the baffle members 140. The baffle members 140 may be rotated to a variety of positions that can affect the direction of air passing through the air channel 118 from the air duct 98. Moreover, the baffle members 140 can be individually or simultaneously rotated either manually or automatically by a controller provided within the refrigerator 20 such as, for example, the controller 110.

Although the baffle members 140 in the examples described above are rotatable to adjustably direct air passing through the air channel 118 from the air duct 98 to the first and/or second compartments 48, 50, the baffle members 140 may additionally or alternatively be rotatable to adjustably direct air passing through the air channel 118 from one of the first and second compartments 48, 50 to the air duct 98 and/or the other of the first and second compartments 48, 50. Moreover, although the baffle members 140 in the examples described above are rotatable to adjustably direct air passing through the air channel 118, the baffle members 140 may be slidable or otherwise adjustable to adjustably direct air passing through the air channel 118 in other examples.

Figure 11:
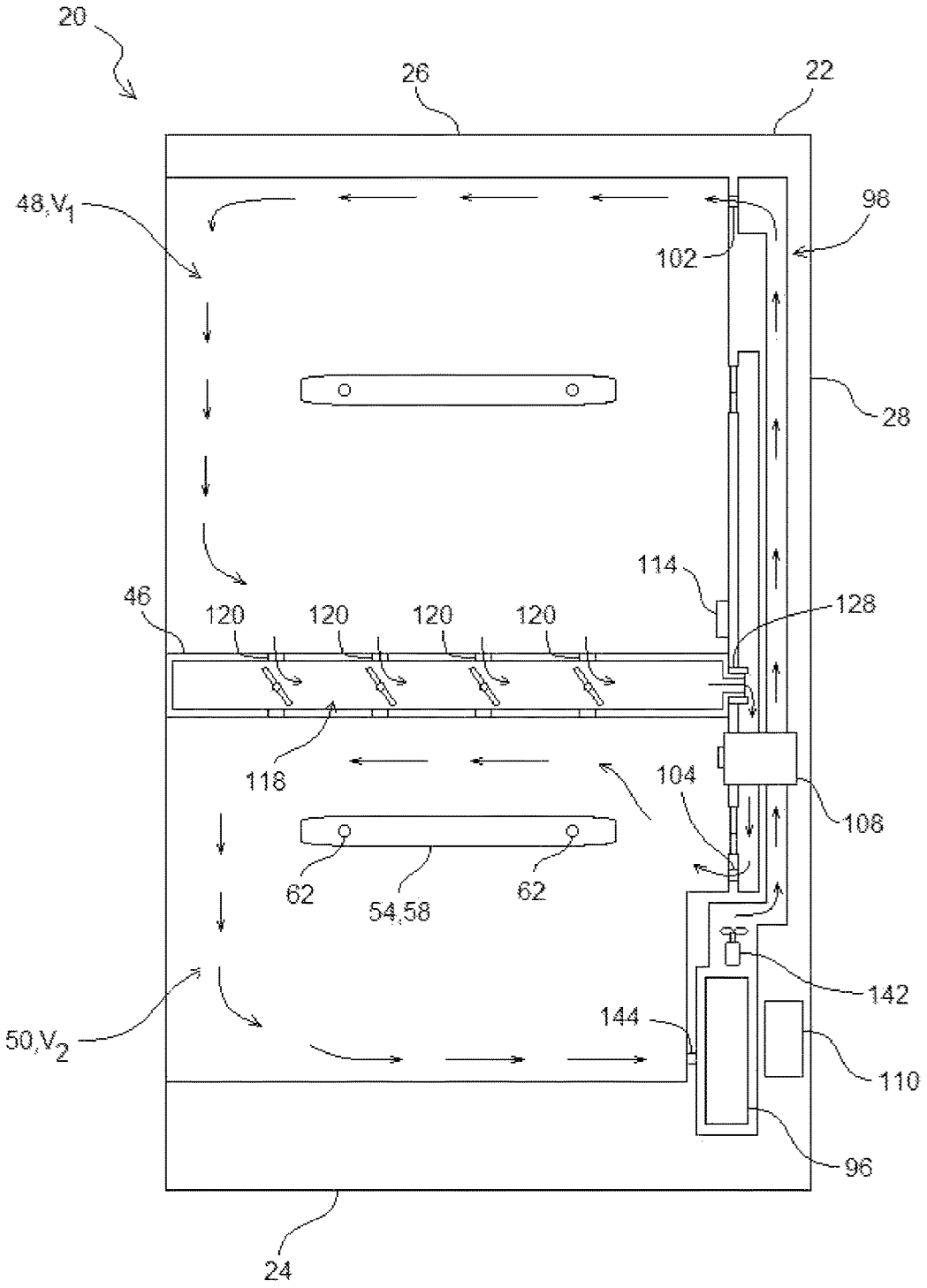
FIG. 11 is a cross-sectional view of the refrigerator taken along line 7-7 in FIG. 1 showing an example air path through the refrigerator.

Turning now to FIG. 11, an example air path will now be described that can be provided with the refrigerator 20 described above. Air can travel past evaporator coils of the evaporator unit 96 to cool the air. A blower 142 can then be operated to deliver the cooled air from the evaporator unit 96 through the air duct 98 and into the first compartment 48 via opening 102. The air delivered to the first compartment 48 may then cycle through an uppermost portion of the first compartment 48 to a front of the first compartment 48 that is adjacent to an inner surface of the door 40. The air may then make its way from the front of the first compartment 48 downward to a bottom of the first compartment 48 adjacent a top surface of the partition member 46. The air can then enter the air channel 118 of the partition member 46 through, for example, the apertures 120 and then return to the air duct 98 through the opening 128. Once returned to the air duct 98, the returned air can pass through the air duct 98 and then enter the second compartment 50 via the opening 104.

Air delivered to the second compartment 50 through the opening 104 may cycle through an uppermost portion of the second compartment 50 to a front of the second compartment 50 that is adjacent to an inner surface of the door 40. The air may then make its way from the front of the second compartment 50 downward to a bottom of the second compartment 50 adjacent the bottom wall 24. The rear wall 28 may include a return air inlet 144 designed to then receive the air and return the air to the evaporator unit 96 for cooling.

A number of examples have been described above. Nevertheless, it will be understood that various modifications may be made. For example, suitable results may be achieved if the described elements are combined in a different manner and/or replaced or supplemented by other elements or their equivalents.

What is claimed is:

1. A refrigerator comprising:

a cabinet having a rear wall and a pair of opposing side walls defining a storage compartment;

a door movably coupled to the cabinet for providing selective access to at least a portion of the storage compartment, the door being movable between an open position and a closed position;

an evaporator unit for cooling air within the storage compartment;

an air duct providing fluid communication between the evaporator unit and the storage compartment;

a partition member coupled to the cabinet that divides the storage compartment into a first compartment having a first volume and a second compartment having a second volume, wherein the partition member is movable between a first position and a second position to adjust the first volume and second volume, the partition member comprises an air channel extending through the partition member, the air channel being in fluid communication with at least one of the first compartment and the second compartment, and the partition member comprises a baffle member that is adjustable to adjustably direct air passing through the air channel, wherein the air duct comprises a first opening providing fluid communication between the air duct and the first compartment through the first opening and a second opening providing fluid communication between the air duct and the second compartment through the second opening;

a flow control device adjustable to control an amount of fluid communication through at least one of the first opening and the second opening; and a controller configured to automatically operate the flow control device based on a position of the partition member.

2. The refrigerator of claim 1, further comprising a sensor configured to detect the position of the partition member and send an input to the controller to indicate what position is detected.

3. The refrigerator of claim 1, wherein the baffle member is rotatable to adjustably direct air passing through the air channel.

4. The refrigerator of claim 1, wherein the air channel is in fluid communication with the first compartment through a first aperture and the air channel is in fluid communication with the second compartment through a second aperture.

5. The refrigerator of claim 4, wherein the baffle member is rotatable to a first position wherein the baffle member is positioned to direct air passing through the air channel away from the second aperture and through the first aperture into the first compartment.

6. The refrigerator of claim 5, wherein the baffle member is rotatable to a second position wherein the baffle member is positioned to direct air passing through the air channel away from the first aperture and through the second aperture into the second compartment.

7. The refrigerator of claim 1, wherein the cabinet comprises a first coupling structure and a second coupling structure, further wherein the partition member is selectively engageable with the first coupling structure to selectively couple the partition member in the first position and the partition member is selectively engageable with the second coupling structure to selectively couple the partition member in the second position.

8. The refrigerator of claim 7, wherein the first coupling structure and the second coupling structure both comprise a rail member provided by one of the opposing side walls or the rear wall that the partition member can selectively rest upon.

9. The refrigerator of claim 7, wherein the first coupling structure and the second coupling structure both comprise a recess provided by one of the opposing side walls or the rear wall that an insertion member of the partition member can selectively be inserted into.

10. The refrigerator of claim 1, further comprising a seal member arranged to provide a seal between the partition member and the door when the partition member is in the first position and the door is in the closed position.

11. The refrigerator of claim 10, wherein the seal member is attached to the partition member.

12. The refrigerator of claim 10, wherein the seal member is selectively attachable to a first connecting structure of the door to provide the seal between the partition member and the door when the partition member is in the first position and the door is in the closed position, further wherein the seal member is selectively attachable to a second connecting structure of the door to provide a seal between the partition member and the door when the partition member is in the second position and the door is in the closed position.

13. The refrigerator of claim 12, further comprising a storage member selectively attachable to the first connecting structure and selectively attachable to the second connecting structure.

14. The refrigerator of claim 1, wherein the partition member is selectively engageable with the first opening to provide fluid communication between the air channel and the air duct through the first opening when the partition member is in the first position and the partition member is selectively engageable with the second opening to provide fluid communication between the air channel and the air duct through the second opening when the partition member is in the second position.

15. The refrigerator of claim 14, wherein the first and second openings each comprise a diaphragm having a hole that an insertion portion of the partition member can be selectively inserted through to provide fluid communication between the air channel and the air duct.

16. A refrigerator comprising:

a cabinet defining a storage compartment;

a door movably coupled to the cabinet for providing selective access to at least a portion of the storage compartment, the door being movable between an open position and a closed position;

a partition member coupled to the cabinet that divides the storage compartment into a first compartment having a first volume and a second compartment having a second volume, wherein the partition member is movable between a first position and a second position to adjust the first volume and second volume;

an evaporator unit for cooling air within the storage compartment;

an air duct providing fluid communication between the evaporator unit and the storage compartment, the air duct comprising a first opening providing fluid communication between the air duct and the first compartment through the first opening, the air duct further comprising a second opening providing fluid communication between the air duct and the second compartment through the second opening;

a flow control device that is adjustable to control an amount of fluid communication through at least one of the first opening and the second opening; and a controller configured to automatically operate the flow control device based on a position of the partition member.

* * * * *